US010820079B2

(12) United States Patent
Ou et al.

(10) Patent No.: US 10,820,079 B2
(45) Date of Patent: Oct. 27, 2020

(54) HEAD MOUNTED DISPLAY DEVICE

(71) Applicant: HTC Corporation, Taoyuan (TW)

(72) Inventors: Kuan-Ying Ou, Taoyuan (TW); Li-Hsun Chang, Taoyuan (TW); Tian-Jia Hsieh, Taoyuan (TW); Yu-Zhen He, Taoyuan (TW); Yen-Chieh Wang, Taoyuan (TW)

(73) Assignee: HTC Corporation, Taoyuan (TW)

( * ) Notice: Subject to any disclaimer, the term of this patent is extended or adjusted under 35 U.S.C. 154(b) by 0 days.

(21) Appl. No.: 16/656,587

(22) Filed: Oct. 18, 2019

(65) Prior Publication Data

US 2020/0245047 A1 Jul. 30, 2020

Related U.S. Application Data

(60) Provisional application No. 62/796,571, filed on Jan. 24, 2019.

(51) Int. Cl.
*H04R 1/02* (2006.01)
*H04R 3/12* (2006.01)
*H04R 1/32* (2006.01)

(52) U.S. Cl.
CPC ..... *H04R 1/025* (2013.01); *H04R 1/323* (2013.01); *H04R 3/12* (2013.01); *H04R 2499/15* (2013.01)

(58) Field of Classification Search
None
See application file for complete search history.

(56) References Cited

U.S. PATENT DOCUMENTS

| | | | | |
|---|---|---|---|---|
| 5,986,813 | A * | 11/1999 | Saikawa | G02B 27/017 359/630 |
| 9,020,168 | B2 * | 4/2015 | Karkkainen | H04R 1/1075 381/151 |
| 2006/0119539 | A1 * | 6/2006 | Kato | G02B 27/0176 345/8 |
| 2014/0152558 | A1 * | 6/2014 | Salter | G09G 5/377 345/157 |
| 2015/0280763 | A1 * | 10/2015 | Ko | H04B 1/385 455/73 |
| 2016/0041392 | A1 * | 2/2016 | Sundquist | G02B 27/0172 345/8 |
| 2016/0116746 | A1 * | 4/2016 | Bae | G02B 27/0176 345/8 |
| 2016/0328021 | A1 * | 11/2016 | Lee | G06F 3/0304 |
| 2018/0284454 | A1 * | 10/2018 | Reed | G06K 9/00671 |
| 2019/0121431 | A1 * | 4/2019 | Lee | G06F 3/015 |
| 2019/0394564 | A1 * | 12/2019 | Mehra | H04S 7/30 |
| 2020/0041803 | A1 * | 2/2020 | Reyes | G09G 5/30 |
| 2020/0137488 | A1 * | 4/2020 | Lovitt | H04R 5/027 |

* cited by examiner

*Primary Examiner* — Paul W Huber
(74) *Attorney, Agent, or Firm* — JCIPRNET

(57) ABSTRACT

A head mounted display device including a main body, a fixing part, a plurality of speakers and at least one actuator is provided. The main body has a display and a base, and the display and the base are in contact with each other. The fixing part is coupled to the main body and forms an accommodation zone with the base. The speakers are respectively disposed on a plurality of positions of the base and the fixing part. The actuator is disposed on the fixing part.

15 Claims, 7 Drawing Sheets

HEAD MOUNTED DISPLAY DEVICE

CROSS-REFERENCE TO RELATED APPLICATION

This application claims the priority benefit of U.S. provisional application Ser. No. 62/796,571, filed on Jan. 24, 2019. The entirety of the above-mentioned patent application is hereby incorporated by reference herein and made a part of this specification.

TECHNICAL FIELD

The invention relates to a head mounted display device, and more particularly, to a head mounted display device that can improve sound quality and immersive listening effect.

BACKGROUND

With the advancement of electronic technology, virtual reality, augmented reality and even mixed reality display effects have become the mainstream of next-generation display technology. However, while improving the visual effect, improving the acoustic effect that the display device can provide is also an important issue for the head-mounted display device.

In the head mounted display device, based on a limited disposition space, a plurality of micro speakers or earphones are often used to provide a sound playing effect. However, the earphone can easily cause discomfort when being worn for a long time, and the micro speaker is restrictive in terms of the small size of the driving element, and sound directionality is quite difficult to be comprehensive and true, resulting in a limitation of the sound playing effect.

SUMMARY

The invention provides a head mounted display device that can improve sound quality and sound directionality.

A head mounted display device of the invention includes a main body, a fixing part, a plurality of speakers and at least one actuator. The main body has a display and a base, and the display and the base are in contact with each other. The fixing part is coupled to the main body and forms an accommodation zone with the base. The speakers may be disposed on a plurality of positions of the base and the fixing part. The actuator is disposed on the fixing part.

Based on the above, the head mounted display device of the invention provides an expandable near field surround sound playback system. In the invention, one or more actuators are disposed together with auxiliary action for experiencing real sensation effect through vibration effect while playing sounds, the experience of virtual reality and better sound quality for immersive listening effect may both be effectively improved.

To make the aforementioned more comprehensible, several embodiments accompanied with drawings are described in detail as follows.

DESCRIPTION OF THE EMBODIMENTS

Figure 1:
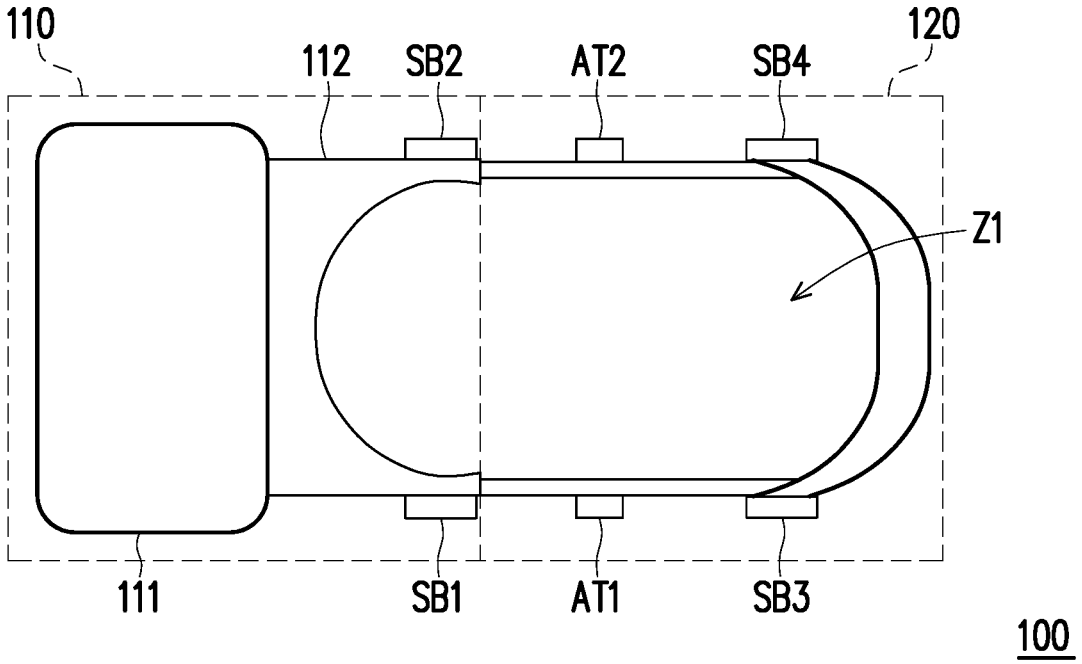
FIG. 1 is a schematic diagram illustrating a head mounted display device in an embodiment of the invention.

Referring to FIG. 1, FIG. 1 is a schematic diagram illustrating a head mounted display device in an embodiment of the invention. A head mounted display device 100 includes a main body 110, a fixing part 120, a plurality of speakers SB1 to SB4 and actuators AT1 and AT2. The main body 110 has a display 111 and a base 112. The base 111 is in contact with the display 112 and configured to support the display 111. The fixing part 120 is coupled to the main body 110 and forms an accommodation zone Z1 with the base 112. The speakers SB1 to SB4 are respectively disposed on a plurality of different positions of the base 110 and the fixing part 120. In this embodiment, the speakers SB1 and SB2 are disposed on two opposite lateral sides of the base 112, and the speakers SB3 and SB4 are disposed on two opposite lateral sides of the fixing part 120. Further, the actuators AT1 and AT2 are disposed on two opposite lateral sides of the fixing part 120. Furthermore, in FIG. 1, the actuator AT1 is disposed between the speakers SB1 and SB3, and the actuator AT2 is disposed between the speakers SB2 and SB4.

In this embodiment, the speakers SB1 to SB4 may be micro speakers. In operation, the speakers SB1 to SB4 may generate a first sound signal individually or collectively. The actuators AT1 and AT2 may generate a second sound signal individually or collectively by means of vibration. Here, a frequency of the first sound signal is greater than a first threshold frequency preset, and a frequency of the second sound signal is less than a second threshold frequency preset. The first threshold frequency and the second threshold frequency may be identical or different.

That is to say, in the embodiment of the invention, when the head mounted display device 100 is to perform a sound playing operation, a portion of a played sound signal higher than the first threshold frequency preset may be played by at least one of the speakers SB1 to SB4. In addition, a portion of the played sound signal lower than the second threshold frequency preset may be played by at least one of the actuators AT1 and AT2. Because the sound signals provided by the speakers SB1 to SB4 based on the micro speakers have a certain effective bandwidth limit, a vibration operation provided by the actuators AT1 and AT2 may effectively expand the bandwidth of the sound signals that can be played by the head mounted display device 100 to improve its sound playing quality.

Figure 2:
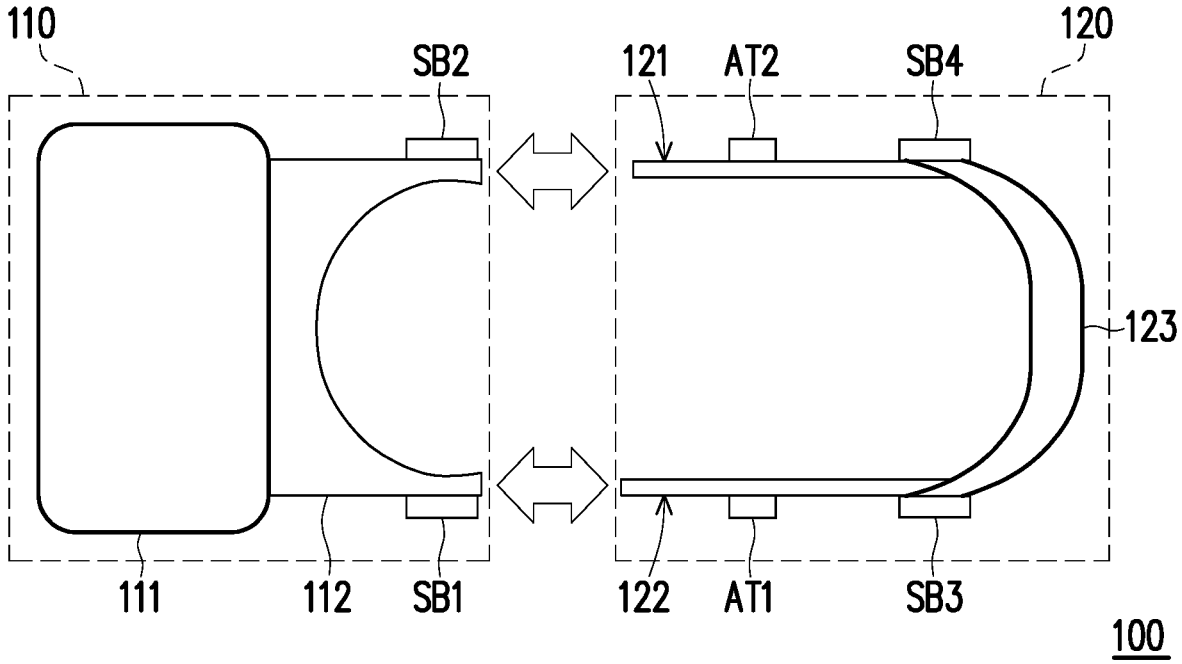
FIG. 2 is a schematic diagram illustrating implementation of the head mounted display device in an embodiment of the invention.

Next, referring to FIG. 2, FIG. 2 is a schematic diagram illustrating implementation of the head mounted display device in an embodiment of the invention. In the head mounted display device 100, the main body 110 is detachably connected to the fixing part 120. Here, the fixing part 120 includes a center component 123 and connecting pieces 121 and 122. The fixing part 120 may be detachably connected to both sides of the base 112 of the main body 110 through the connecting pieces 121 and 122. A connection manner for connecting the connecting pieces 121 and 122 to the base 112 may be accomplished by detachable connecting members well known to those skilled in the art without particular limitations.

The head mounted display device 100 may also be a non-detachable independent system, and is not limited to the above-described connection manner of the head mounted display device 100. In addition, the head mounted display device 100 may also be a single multi-headband listening device without a limited wearing height, wherein the wearing height may be parallel to an ear height.

Further, to be adapted for different head shapes of the users, the center component 123 and the connecting pieces 121 and 122 included in the fixing portion 120 may be constructed by a flexible band structure. In addition, the actuators AT1 and AT2 are respectively disposed on the connecting pieces 121 and 122, and the actuators AT1 and AT2 may be devices like a haptics feedback vibrator, a vibrator, a piezo electrical material driver or a bone conductor. The actuators AT1 and AT2 may be fixed onto, for example, the connecting pieces 121 and 122 having a foam structure. Since the head mounted display device 100 has sufficient areas in contact with the skin, the connecting pieces 121 and 122 may provide a sufficiently large area in contact with the skin of the user to allow the vibration to be transmitted to the skin surface of the user and make the user feel the vibration more evenly. In addition, with a phase control the actuators AT1 and AT2, the user can receive a variety of different sensations of impact, extraction, or transverse shear.

The actuators AT1 and AT2 may provide the user with a low-frequency tactile sensation, and provide the most realistic listening experience through materials (e.g., foam) provided on the connectors 121 and 122 in contact with the user and the phase control of the vibration, and solve the problem that the speaker SB1 to SB4 based on the micro speaker cannot provide sufficient bandwidth. The actuators AT1 and AT2 may extend the bandwidth of the sound for more realistic listening. In addition, inphase and outphase phases of the two actuators AT1 and AT2 at opposite positions may be used to control the vibration and the sensations, and an amplitude of the vibration may be finely adjusted to increase delicateness of the vibration received by the user. For instance, when a shock of the vibration is played, the actuators AT1 and AT2 will conduct an interactive vibration in a first direction and a second direction so the user can sense the differences in impact or absorption. When the impact of low frequency is to e sensed, the actuators AT1 and AT2 can separately or collectively control the phases in different vibration directions, and allow the user to have a more delicate and real sensation. In this way, the realism of the listening and tactile sensations of the head mounted display device 100 may be improved.

Incidentally, the vibration directions of the first direction and the second direction may be opposite to each other, the same, perpendicular, or have an arbitrary angle without particular limitations.

Figure 3:
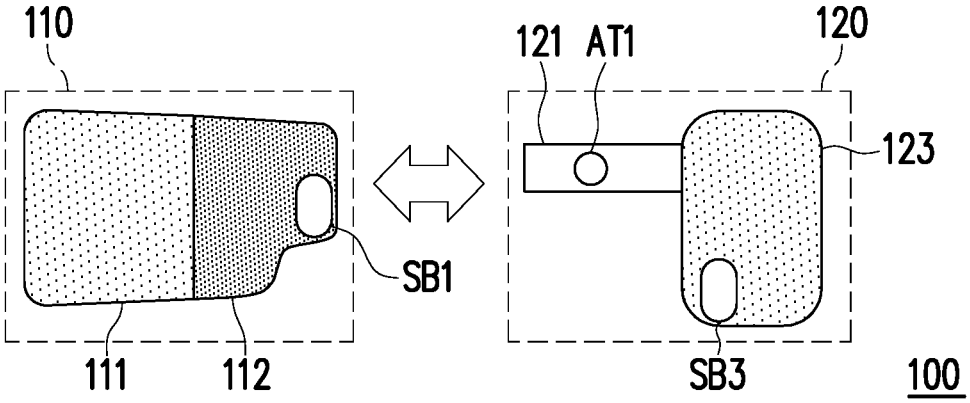
FIG. 3 is a side view of the head mounted display device 100 in an embodiment of the invention.
Figure 4:
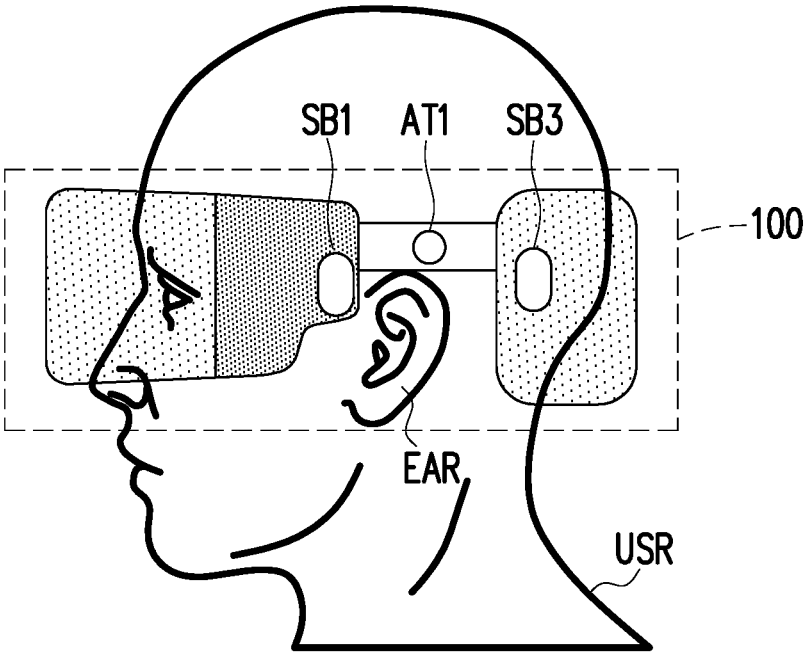
FIG. 4 is a schematic diagram illustrating a state in which the head mounted display device 100 is worn on the user in an embodiment of the invention.

Referring to FIG. 3 and FIG. 4, FIG. 3 is a side view of the head mounted display device 100 in an embodiment of the invention, and FIG. 4 is a schematic diagram illustrating a state in which the head mounted display device 100 is worn on the user in an embodiment of the invention. In FIG. 3, the speaker SB1 is disposed on the base 112 of the main body 110, the speaker SB3 is disposed on the center component 123 of the fixing part 120, and the actuator AT1 is disposed on the connecting piece 121 of the fixing part 120. Among them, the speaker SB1, the actuator AT1, and the speaker SB3 do not need be disposed on the same horizontal line. Here, referring to FIG. 4, the speaker SB1, the actuator AT1 and the speaker SB3 may be disposed surrounding an ear EAR of a user USR to provide a sound effect of surround sound field. In this implementation, the speaker SB1 may be a front speaker, and the speaker SB3 may be a rear speaker. Among them, the speaker SB1 is disposed in front of the ear EAR, the speaker SB3 is disposed at the back of the ear EAR, and the actuator AT1 is disposed above the ear EAR.

Figure 5:
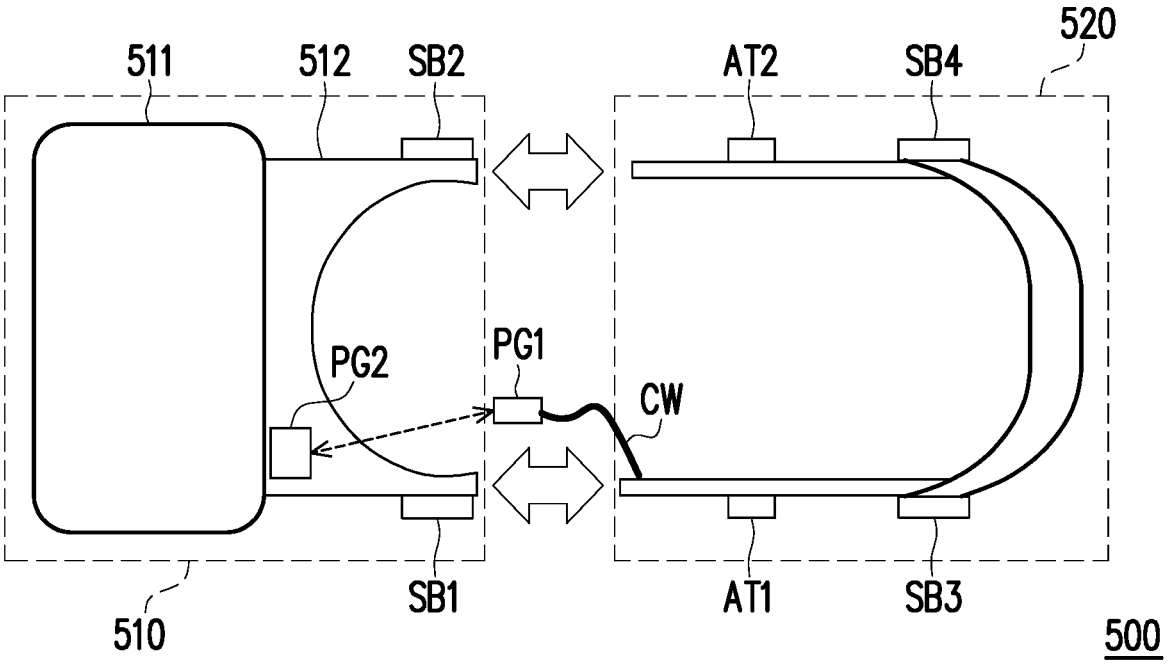
FIG. 5 is a schematic diagram illustrating a head mounted display device in another embodiment of the invention.

Further, referring to FIG. 5, FIG. 5 is a schematic diagram illustrating a head mounted display device in another embodiment of the invention. A head mounted display device 500 includes a main body 510, a fixing part 520, a plurality of speakers SB1 to SB4 and actuators AT1 and AT2. The main body 510 has a display 511 and a base 512. The base 512 and the display 511 are in contact with each other. The fixing part 520 is detachably connected to the main part 510. Moreover, the head mounted display device 500 further includes a transmission wire CW, an electrical connection plug PG1 and an electrical connection socket PG2. In this embodiment, the transmission wire CW is connected to the electrical connection plug PG1 and connected to the fixing part 520. When the main body 510 and the fixing part 520 are electrically connected to each other, the electrical connection plug PG1 may be plugged into the electrical connection socket PG2 so that the main body 510 and the transmission wire CW are electrically connected to each other. In this embodiment, the electrical connection socket PG2 may also be coupled to a controller (not illustrated) in the main body 510, and the controller may transmit a plurality of driving signals to the speakers (rear speakers) SB3 and SB4 and the actuators AT1 and AT2 through the transmission wire CW.

It should be noted that, the electrical connection plug PG1, the electrical connection socket PG2 and the transmission wire CW in this embodiment can be implemented by components well known to those skilled in the art without particular limitations.

Figure 6:
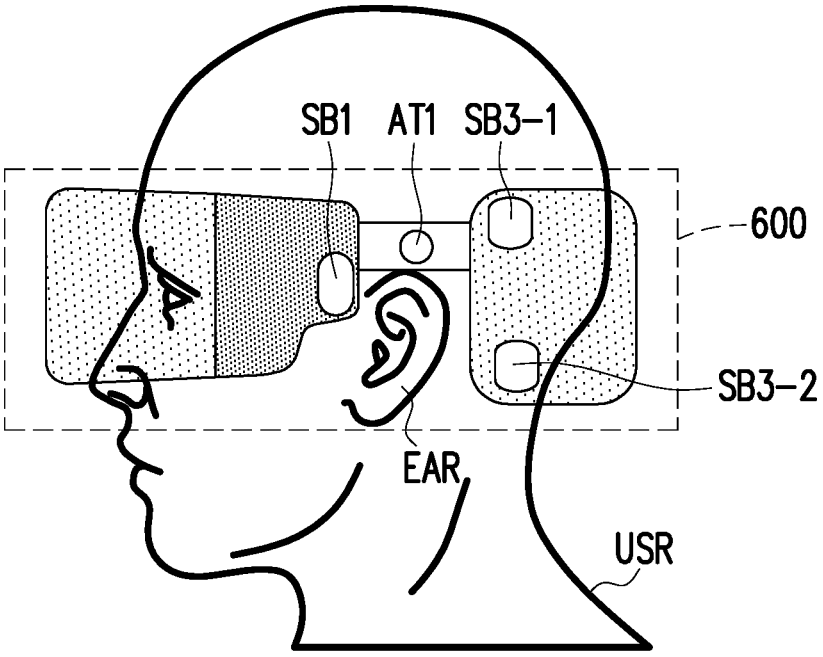
FIG. 6 is a schematic diagram illustrating a state in which the head mounted display device 600 is worn on the user in another embodiment of the invention.

Referring to FIG. 6, FIG. 6 is a schematic diagram illustrating a state in which the head mounted display device 600 is worn on the user in another embodiment of the invention. In FIG. 6, additional (rear) speakers SB3-1 and SB3-2 are disposed on the head mounted display device 600. In this embodiment, levels of the sound effect can be effectively improved by the speaker SB3-1 above and the speaker SB3-2 below.

It is should be noted that, the front speakers (the speaker SB1) of the embodiment of the invention are not limited to one per each side. With enough space of the main body, more of front speakers may also be disposed on the head mounted display device 600, and the number of which is not particularly limited.

Figure 7:
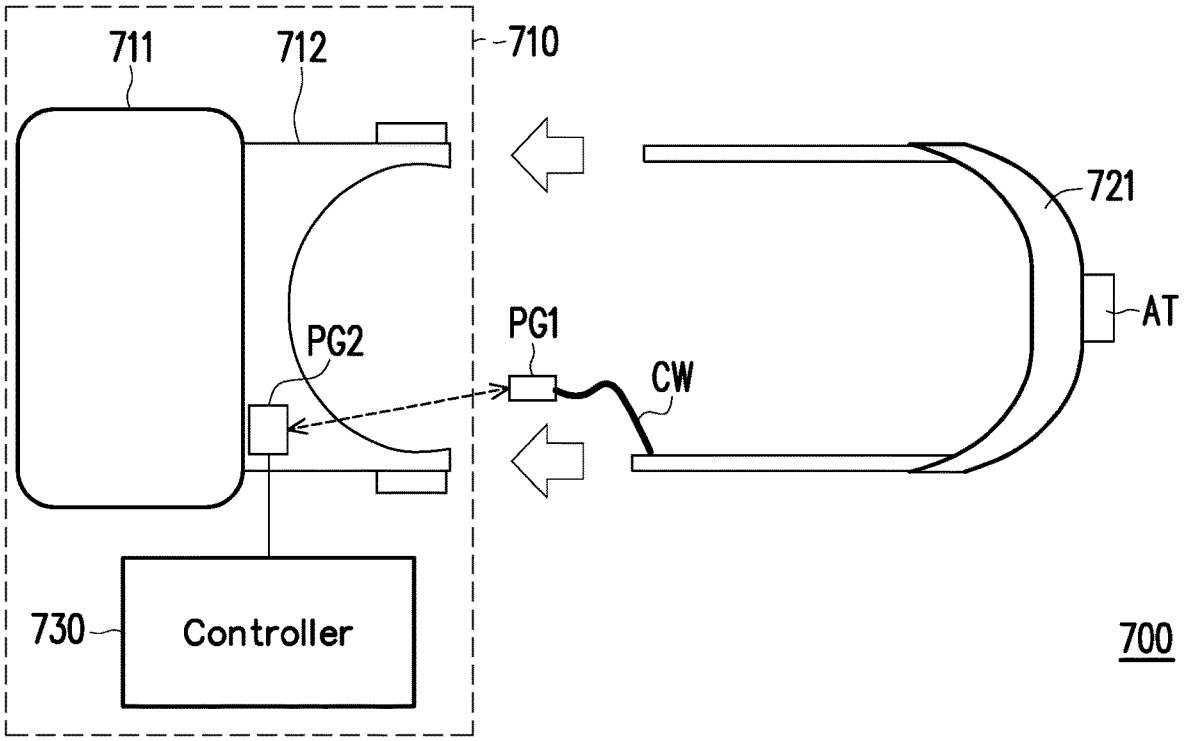
FIG. 7 is a schematic diagram illustrating a head mounted display device in another embodiment of the invention.

Referring to FIG. 7, FIG. 7 is a schematic diagram illustrating a head mounted display device in another embodiment of the invention. A head mounted display device 700 include a display 711, a base 712, a main part 710, a center component 721, a plurality of speakers SB1 to SB4, an actuator AT, a controller 730, a transmission wire CW, an electrical connection plug PG1 and an electrical connection socket PG2. In this embodiment, the head mounted display device 700 includes only one single actuator AT, which is disposed on the central component 721. A position of the actuator AT may correspond to the back of the user's head and provide a low frequency vibration to increase a frequency range of the sound effect.

In addition, the controller 730 is configured to perform a sound processing on the sound to be played, and generate a plurality of driving signals corresponding to the speakers SB1 to SB4 and the actuator AT. The controller 730 then transmits the driving signals to the speakers SB1 to SB4 to effectively play the surround sound effect.

It should be noted that in this embodiment of the invention, more actuators (e.g., the actuators AT1 and AT2) may also be disposed on the head mounted display device 700 as shown by FIG. 5, and is not limited to only the actuator AT.

Incidentally, the controller 730 in this embodiment may be an independent processor with computing capability, or the controller 730 may be an integrated digital audio codec. The controller 730 may be a hardware circuit designed through a software control or Hardware Description Language (HDL) or any other design methods for digital circuit well-known to persons with ordinary skill in the art and may be implemented in from of Digital Signal Processing Unit, Field Programmable Gate Array (FPGA), Complex Programmable Logic Device (CPLD) or Application-specific Integrated Circuit (ASIC).

Figure 8:
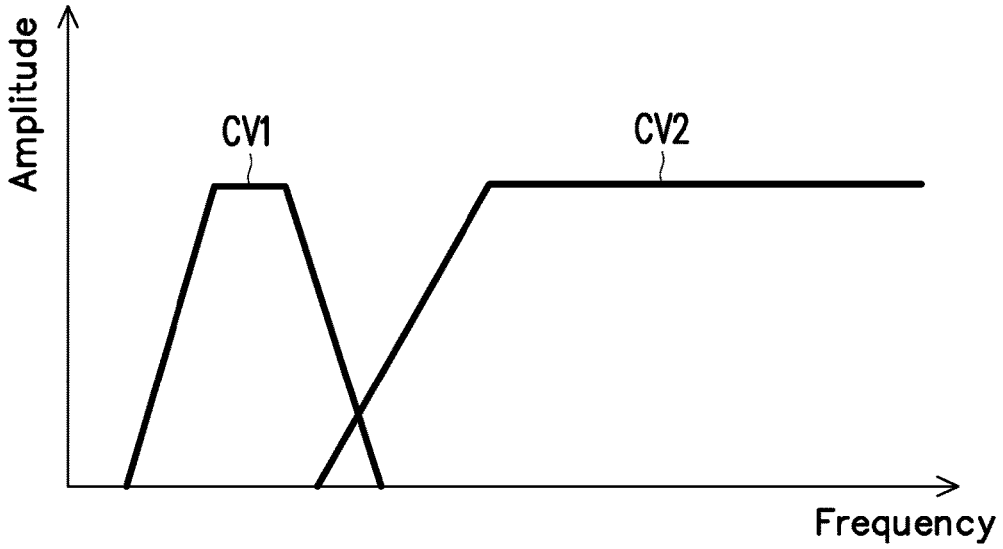
FIG. 8 is a schematic diagram illustrating frequency ranges of sound effects of the speaker and the actuator in an embodiment of the invention.

Referring to FIG. 8, FIG. 8 is a schematic diagram illustrating frequency range of sound effects of the speaker and the actuator in an embodiment of the invention. Here, a curve CV1 represents a schematic diagram of the frequency range in which the actuator in the head mounted display device generates the vibration, and the curve CV2 represents a schematic diagram of the frequency range in which the speaker in the head mounted display device generates the sound effect. A distribution range of the curve CV2 is higher than a first threshold frequency preset, and a distribution range of the curve CV1 may be lower than a second threshold frequency preset. In this embodiment of the invention, the distribution ranges and heights of the two curves CV1 and CV2 may be adjusted to curves for best human body sensation, and as the purpose is to achieve the best feeling, threshold ranges of the curves CV1 and CV2 are not particularly limited. In the design, the curves may be completely separated or partially overlapped.

Figure 9A:
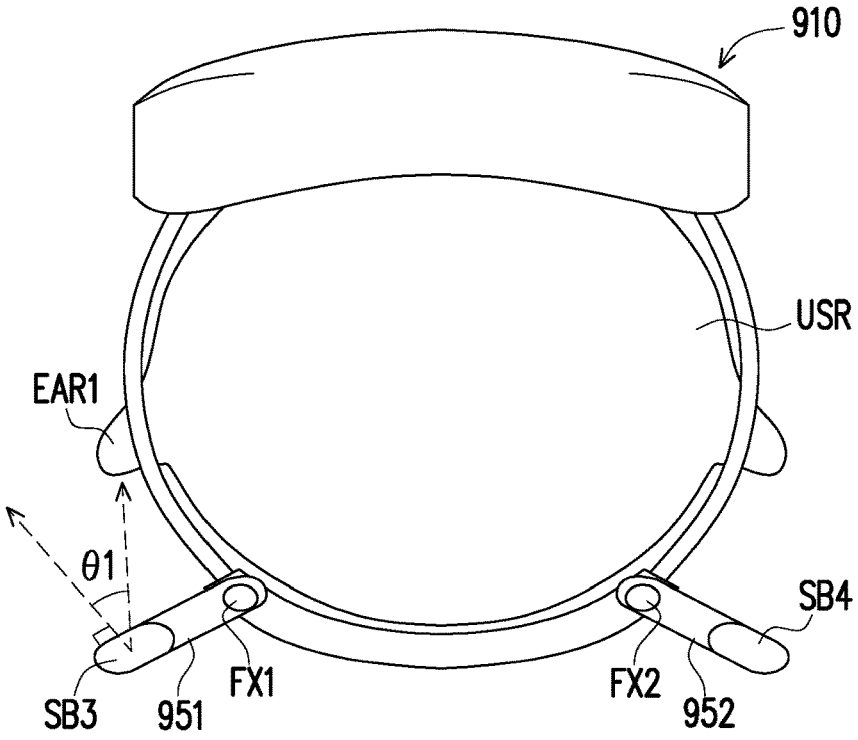
FIG. 9A, FIG. 9B and FIG. 9C are schematic diagrams respectively illustrating a head mounted display device in another embodiment of the invention.
Figure 9B:
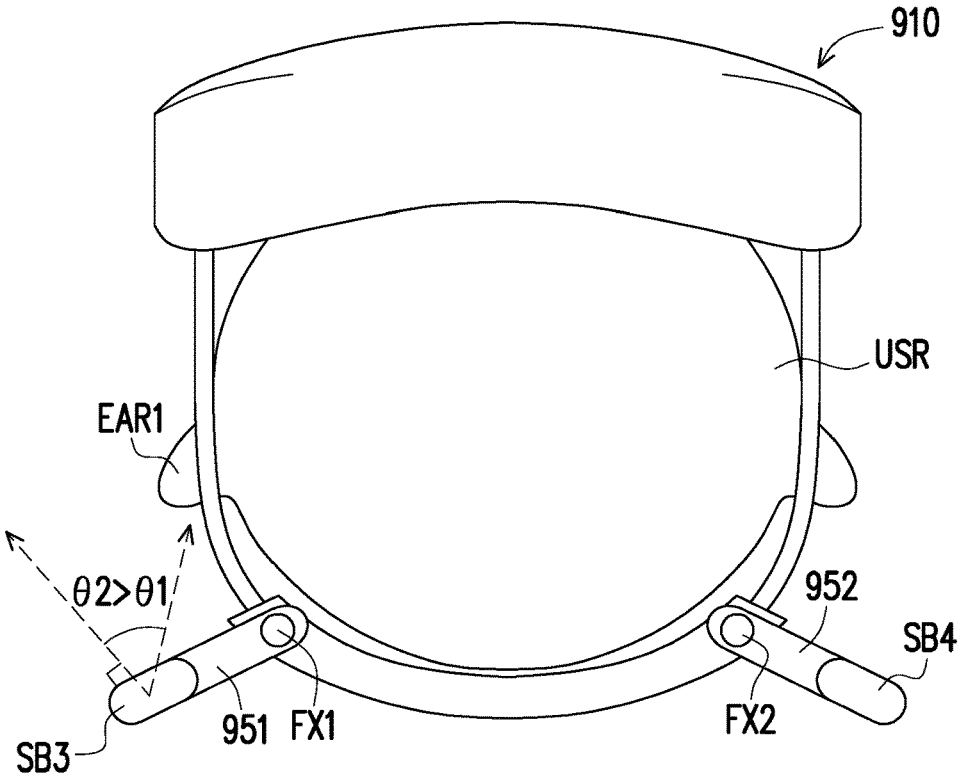
Figure 9C:
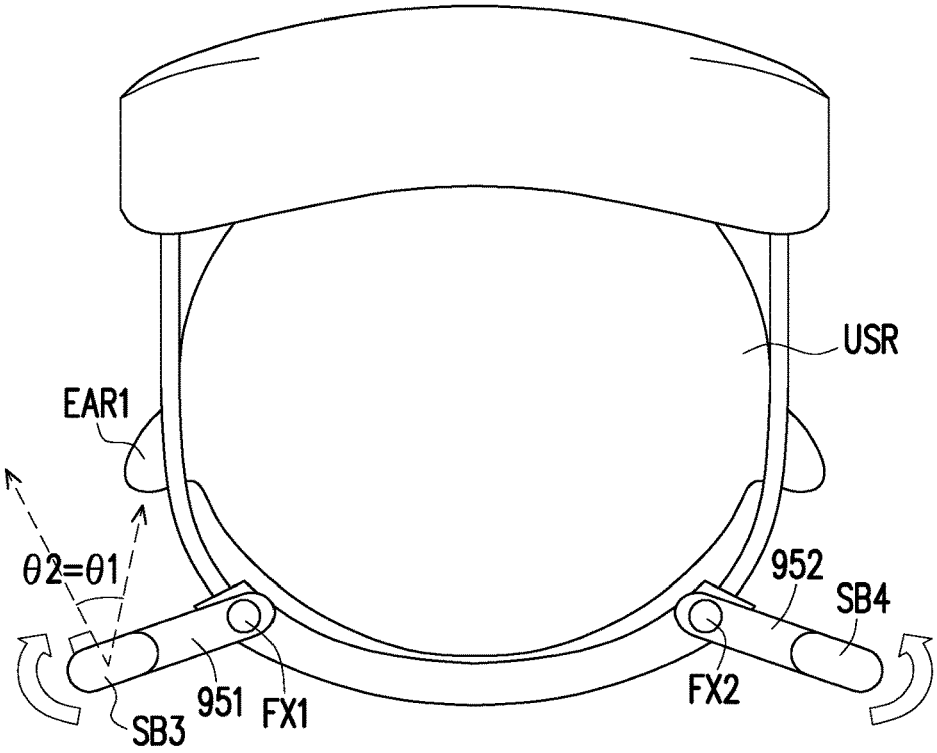

Referring to FIG. 9A, FIG. 9B and FIG. 9C, FIG. 9A, FIG. 9B and FIG. 9C are schematic diagrams respectively illustrating a head mounted display device in another embodiment of the invention. In FIG. 9A, a head mounted display device 910 includes adjustable mechanisms 951 and 952. The adjustable mechanisms 951 and 952 are connected to (rear) speakers SB3 and SB4, respectively, and are disposed on a fixing part of the head mounted display device 910.

Through the adjustment mechanisms of the adjustable mechanisms 951 and 952, sound transmission directions of the speakers SB3 and SB4 may be adjusted. Taking the speaker SB3 as an example, with the adjustment operation of the adjustable mechanism 951, the sound transmission direction of the speaker SB3 may be adjusted to make an included angle between extending directions of the speaker SB3 and of an ear EAR1 of the user USR become a preset angle θ1.

In addition, the adjustable mechanisms 951 and 952 respectively include fixing pieces FX1 and FX2 which can be used to respectively fix the adjustable mechanisms 951 and 952 after the user USR have adjusted the positions of the speakers SB3 and SB4.

In FIG. 9B, based on different users USR having different sizes of head profiles, when the head mounted display device 910 is worn on the user USR having larger head size, the sound transmission direction of the speaker SB3 may be adjusted to make the included angle between the extending directions of the speaker SB3 and of the ear EAR1 of the user USR become an angles θ2 that is different from (greater than) the preset angle θ1. Consequently, due to the sound effect of the sound field positioning sent by the speaker SB3, the user USR may not be able to correctly sense and receive signals. At this time, the user USR can adjust the adjustable mechanism 951 and make the angle θ2 equal to the preset angle θ1, so that an angle of the sound received by the user USR may be effectively controlled to conform to the designer's angle effect.

In addition, the adjustable mechanisms 951 and 952 in the embodiments of the invention can provide different sensor reference values according to a rotation angle, respectively. The adjustable mechanisms 951 and 952 can provide the sensor reference values respectively to the controller of the head mounted display device 910. The controller can thereby obtain position information of the speakers SB3 and SB4, generate a modified driving signal according to the user's wearing size and the adjusted angle, so that the speakers SB3 and SB4 provide can a better sound positioning effect to increase the sound realism. The head mounted display device 910 can also correct a deviation in listening caused by a wearing error.

Figure 10:
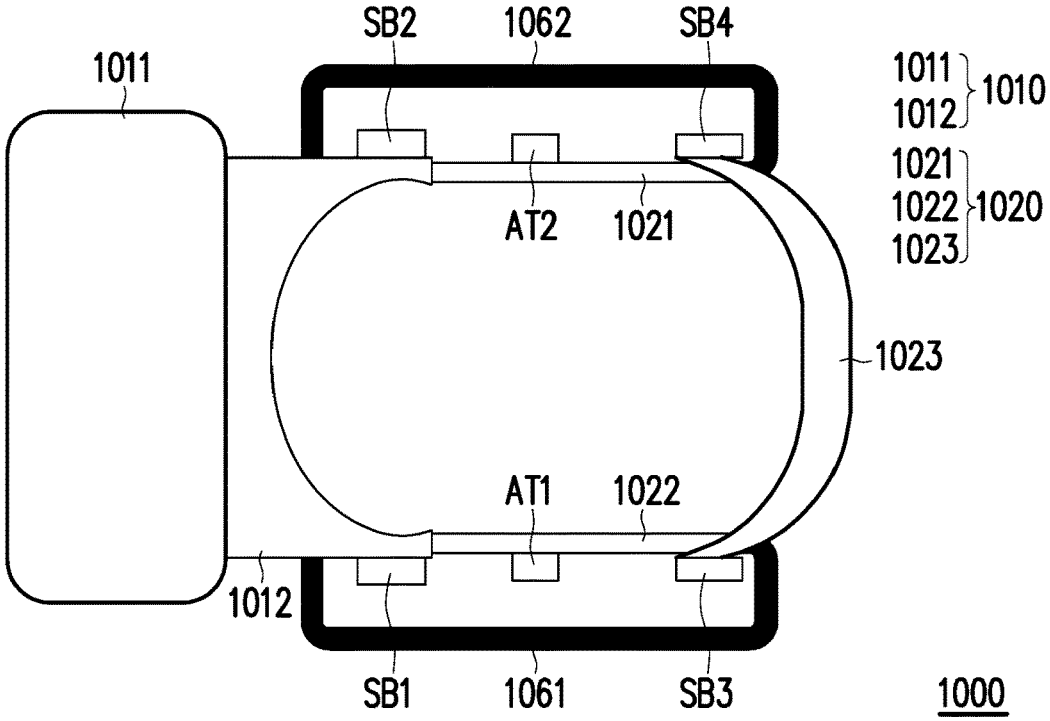
FIG. 10 is a schematic diagram illustrating a head mounted display device in another embodiment of the invention.

Referring to FIG. 10, FIG. 10 is a schematic diagram illustrating a head mounted display device in another embodiment of the invention. A head mounted display device 1000 includes a main body 1010, a fixing part 1020, speakers SB1 to SB4, actuators AT1 and AT2, and sound insulation structures 1061 and 1062. The main body 1010 includes a display 1011 and a base 1012. The fixing part 1020 includes a center component 1023 and connecting pieces 1021 and 1022. The speakers SB1 and SB2 are disposed on two lateral sides of the base 1012, and the speakers SB3 and SB4 are respectively disposed on the connecting pieces 1021 and 1022. The actuators AT12 and AT11 are respectively disposed on the connection pieces 1021 and 1022. In this embodiment, the sound insulation structure 1061 is disposed between the main part 1010 and the fixing part 1020 and used as a block for the speaker SB1 (the front speaker), the speaker SB3 (the rear speaker) and the actuator AT1. The sound insulation structure 1062 is also disposed between the main part 1010 and the fixing part 1020 and used as a block for the speaker SB2 (the front speaker), the speaker SB4 (the rear speaker) and the actuator AT2.

Figure 11:
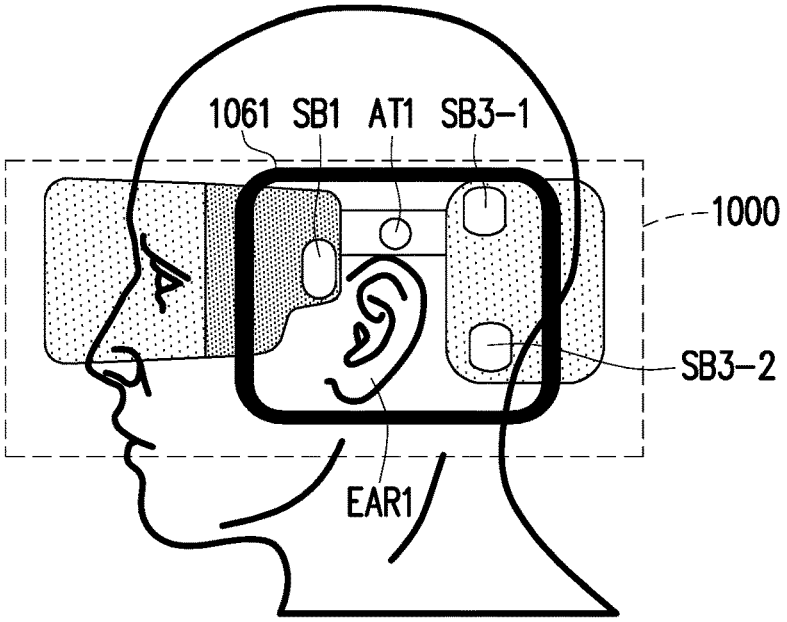
FIG. 11 is a schematic diagram illustrating a state in which the head mounted display device 1000 is worn on the user.

When the user is wearing the head mounted display device 1000, the sound insulation structures 1061 and 1062 can block the ears of the user at both sides, so as to prevent the user from being disturbed by external noises when listening to the sound. The related state of the above may be referred to FIG. 11, which is a schematic diagram illustrating a state in which the head mounted display device 1000 is worn on the user. In FIG. 11, the sound insulation structure 1061 blocks the ear EAR1, the speakers SB1, SB3-1 and SB3-2 and the actuator AT1 at the same time.

Figure 12:
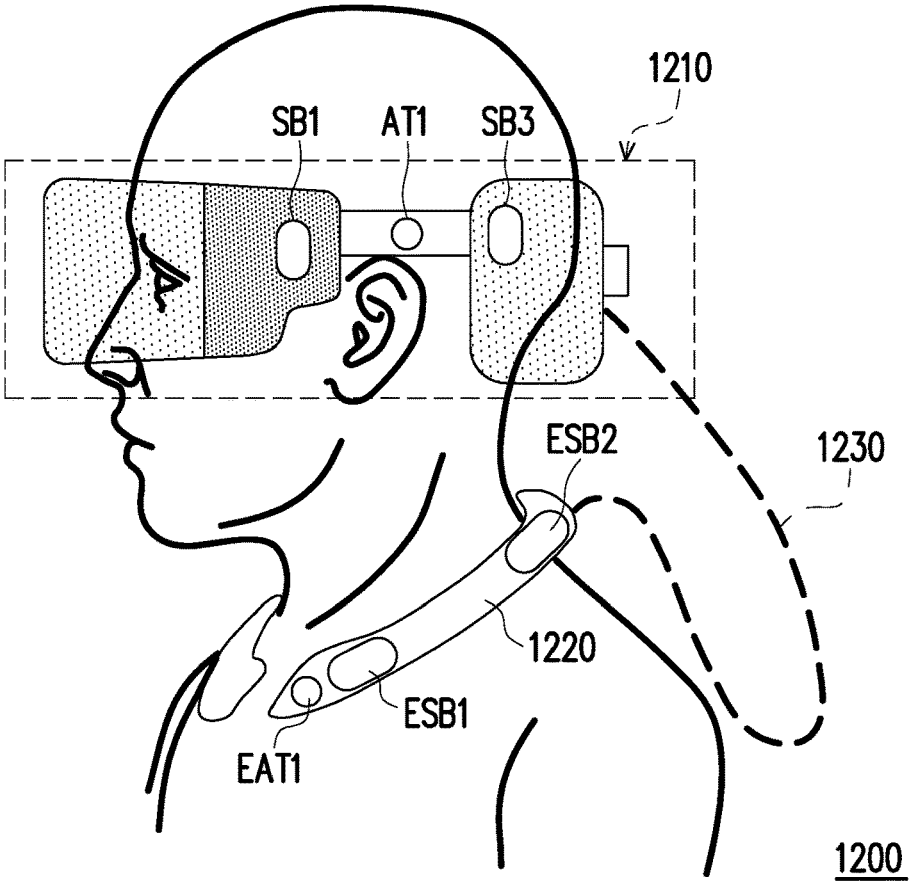
FIG. 12 is a schematic diagram illustrating a head mounted display device in another embodiment of the invention.

Referring to FIG. 12, FIG. 12 is a schematic diagram illustrating a head mounted display device in another embodiment of the invention. A head mounted display device 1200 includes a main body, a fixing part combination 1210, speakers SB1 and SB3, an actuator AT1, and an expansion part 1220. The expansion part 1220 has a band structure, and one or more expansion speakers ESB1 and ESB2 and one or more expansion actuators EAT1 are disposed on the band structure. The expansion part 1220 may be electrically coupled to the fixing part or the main body of the head mounted display device 1200 through a connecting wire 1220, and receive a plurality of driving signals through the connecting wire 1220, so as to respectively drive the expansion speakers ESB1 and ESB2 and the expansion actuator EAT1.

In this embodiment, the expansion part 1220 may be worn on the front side of the chest of the user and used to provide more levels of sound effects.

In summary, one or more actuators are disposed in the head mounted display device of the invention. With the actuator play sounds of different frequencies together with the speaker or through independent control, the sound laying effect of the head-mounted display device may be improved.

Although the present invention has been described with reference to the above embodiments, it will be apparent to one of ordinary skill in the art that modifications to the described embodiments may be made without departing from the spirit of the invention. Accordingly, the scope of the invention will be defined by the attached claims and not by the above detailed descriptions.

What is claimed is:

1. A head mounted display device, comprising:

a main body, having a display and a base, the display and the base being in contact with each other;

a fixing part, coupled to the main body and forming an accommodation zone with the base;

a plurality of speakers, respectively disposed on a plurality of positions of the base and the fixing part; and at least one actuator, disposed on the fixing part, wherein the fixing part comprises a first connecting piece and a second connecting piece, and the fixing part is detachably connected to a first end and a second end of the base through the first connecting piece and the second connecting piece respectively, and a first front speaker and a second front speaker of the speakers are respectively disposed on the first end and the second end of the base, and a first rear speaker and a second rear speaker of the speakers are respectively disposed on the first connecting piece and the second connecting piece.

2. The head mounted display device according to claim 1, wherein the head mounted display device generates a first sound signal through at least one of the speakers, and generates a second sound signal through the at least one actuator, wherein a frequency of the first sound signal is greater than a first threshold frequency preset, and a frequency of the second sound signal is less than a second threshold frequency preset, wherein the first threshold frequency and the second threshold frequency are identical or different.

3. The head mounted display device according to claim 1, wherein the first connecting piece and the second connecting piece are respectively fixed together with the first end and the second end of the base.

4. The head mounted display device according to claim 1, wherein the first front speaker and the first rear speaker are disposed adjacent to a first ear of a user, and the second front speaker and the second rear speaker are disposed adjacent to a second ear of the user.

5. The head mounted display device according to claim 1, wherein the at least one actuator comprises a first actuator and a second actuator, and the first actuator and the second actuator are respectively disposed on the first connecting piece and the second connecting piece.

6. The head mounted display device according to claim 5, further comprising:

a first sound insulation structure and a second sound insulation structure, disposed between the main body and the fixing part; the first sound insulation structure is configured to block the first front speaker, the first rear speaker and the first actuator; and the second sound insulation structure is configured to block the second front speaker, the second rear speaker and the second actuator.

7. The head mounted display device according to claim 1, wherein the at least one actuator is disposed on a center component of the fixing part.

8. The head mounted display device according to claim 1, further comprising:

a plurality of transmission wires, coupled to the first rear speaker, the second rear speaker, the first actuator and the second actuator, and configured to transmit a plurality of driving signals.

9. The head mounted display device according to claim 8, wherein the main body further comprises an electrical connection socket, the electrical connection socket is disposed on the base, the transmission wires are collectively coupled to an electrical connection plug, and the electrical connection plug is detachably connected to the electrical connection socket.

10. The head mounted display device according to claim 9, wherein the main body further comprises a controller, electrically coupled to the electrical connection socket to transmit the driving signals.

11. The head mounted display device according to claim 1, wherein the first rear speaker and the second rear speaker are respectively disposed on the fixing part through a first adjustable mechanism and a second adjustable mechanism.

12. The head mounted display device according to claim 11, wherein the first adjustable mechanism and the second adjustable mechanism respectively adjust positional relationships of the first rear speaker and the second rear speaker with respect to the first ear and the second ear of the user.

13. The head mounted display device according to claim 11, wherein the first adjustable mechanism provides a first resistance according to a rotation angle, and the second adjustable mechanism provides a second resistance according to the rotation angle.

14. The head mounted display device according to claim 11, wherein a first fixing piece and a second fixing piece are respectively provided on the first adjustable mechanism and the second adjustable mechanism, and configured to fix positions of the first rear speaker and the second rear speaker.

15. The head mounted display device according to claim 11, further comprising:

an expansion part having a band structure, at least one expansion speaker and at least one expansion actuator being disposed on the band structure, wherein the expansion part is electrically coupled to the fixing part or the main body to receive a plurality of expansion driving signals.

* * * * *